US010931032B2

(12) United States Patent
Song et al.

(10) Patent No.: US 10,931,032 B2
(45) Date of Patent: Feb. 23, 2021

(54) SPLIT DIAMOND ANTENNA ELEMENT FOR CONTROLLING AZIMUTH PATTERN IN DIFFERENT ARRAY CONFIGURATIONS

(71) Applicant: QUINTEL CAYMAN LIMITED, Grand Cayman (KY)

(72) Inventors: Peter Chun Teck Song, San Jose, CA (US); David Edwin Barker, Stockport (GB); Karl Ni, Rochester, NY (US)

(73) Assignee: Quintel Cayman Limited, Grand Cayman (KY)

( * ) Notice: Subject to any disclaimer, the term of this patent is extended or adjusted under 35 U.S.C. 154(b) by 0 days.

(21) Appl. No.: 16/526,426

(22) Filed: Jul. 30, 2019

(65) Prior Publication Data

US 2020/0044362 A1 Feb. 6, 2020

Related U.S. Application Data

(60) Provisional application No. 62/712,925, filed on Jul. 31, 2018.

(51) Int. Cl.
*H01Q 21/24* (2006.01)
*H01Q 1/24* (2006.01)
(Continued)

(52) U.S. Cl.
CPC ..... *H01Q 21/24* (2013.01); *H01Q 1/246* (2013.01); *H01Q 5/30* (2015.01); *H01Q 19/10* (2013.01); *H01Q 21/0025* (2013.01)

(58) Field of Classification Search
CPC .. H01Q 21/24; H01Q 21/0025; H01Q 21/245; H01Q 21/26; H01Q 1/246;
(Continued)

(56) References Cited

U.S. PATENT DOCUMENTS

2006/0071870 A1 4/2006 Saito et al.
2006/0208944 A1 9/2006 Haskell
(Continued)

FOREIGN PATENT DOCUMENTS

EP 1202387 B1 8/2004

OTHER PUBLICATIONS

PCT Search Report and Written Opinion mailed in corresponding PCT/US2019/044136 dated Oct. 22, 2019, 16 pages.

*Primary Examiner* — Raymond R Chai
(74) *Attorney, Agent, or Firm* — Tong, Rea, Bentley & Kim, LLC

(57) ABSTRACT

An antenna system includes unit cells arranged as an array of unit cells, each unit cell including at least one dual-polarized antenna element for operation in a first radio frequency (RF) range, and least one configured as an expanded diamond antenna element with first and second pairs of co-polarized radiating elements, the first and second pairs of co-polarized radiating elements having orthogonal polarizations. The unit cell for the at least one expanded diamond antenna element may have rectangular bounds, where first and second radiating elements of the first pair of co-polarized radiating elements are disposed in first opposite corners across a first diagonal of the rectangular bounds and within the rectangular bounds, and where first and second radiating elements of the second pair of co-polarized radiating elements are disposed in second opposite corners of the four corners across a second diagonal of the rectangular bounds and within the rectangular bounds.

19 Claims, 9 Drawing Sheets

(51) Int. Cl.
*H01Q 19/10* (2006.01)
*H01Q 21/00* (2006.01)
*H01Q 5/30* (2015.01)

(58) Field of Classification Search
CPC ..... H01Q 19/10; H01Q 5/30; H01Q 5/48; H01Q 15/14
See application file for complete search history.

(56) References Cited

U.S. PATENT DOCUMENTS

| | | | | |
|---|---|---|---|---|
| 2009/0079645 | A1* | 3/2009 | Sotelo | H01Q 3/46 343/755 |
| 2009/0146907 | A1* | 6/2009 | Brown | H01Q 15/14 343/912 |
| 2012/0146869 | A1 | 6/2012 | Holland et al. | |
| 2018/0040955 | A1 | 2/2018 | Vouvakis et al. | |
| 2019/0027814 | A1* | 1/2019 | Hsu | H01Q 19/22 |
| 2019/0036231 | A1* | 1/2019 | Ryu | H01Q 21/24 |
| 2019/0190165 | A1* | 6/2019 | Biancotto | H01Q 9/04 |
| 2020/0106174 | A1* | 4/2020 | Jan | H01Q 21/062 |

* cited by examiner

600

800

900

SPLIT DIAMOND ANTENNA ELEMENT FOR CONTROLLING AZIMUTH PATTERN IN DIFFERENT ARRAY CONFIGURATIONS

CROSS REFERENCE TO RELATED APPLICATIONS

This application claims priority to U.S. Provisional Patent Application Ser. No. 62/712,925, filed Jul. 31, 2018, which is herein incorporated by reference in its entirety.

FIELD OF THE DISCLOSURE

The present disclosure relates generally to cross-polarized antenna arrays, and more specifically to antenna arrays with improved sector power ratio.

BACKGROUND

Additional spectrum bands have been released in recent years, and cellular operators have been deploying new radio access technologies to meet subscriber traffic demands. Not only does the antenna system need to support multiple bands operating over a very large bandwidth (for example, low band (LB), e.g., 617-960 MHz, and high band (HB), e.g., 1.4-2.7 GHz), the antenna system needs to have good radiation properties with good isolation. Dual-polarized antenna elements driven via two independent RF ports are widely used in mobile communication as a diversity technique to help mitigate radio channel fading. In order to meet the growing mobile data demand, more and more antenna elements operating at similar, and at different frequency bands of operation are packed onto a single antenna reflector. To further enhance network capacity, advanced radio systems such as Long-Term Evolution-Advanced (LTE-A) may use multiple input multiple output (MIMO) antenna system where two dual-polarized antenna array columns of the LB and two dual-polarized antenna array columns of the HB are packed together for connection to a four transmit, four receive (4T4R) base station radio unit for LB and for connection to a 4T4R radio for HB. In general, N/2 number of dual-polarized antenna arrays can be grouped together to enable an NTNR system for each band.

SUMMARY

In one example, the present disclosure describes an antenna system having a first plurality of unit cells arranged as an array of unit cells, each unit cell of the first plurality of unit cells including at least one dual-polarized antenna element for operation in a first radio frequency (RF) range. In one example, the at least one dual-polarized antenna element in at least one unit cell of the first plurality of unit cells is configured as an expanded diamond antenna element comprising a first pair of co-polarized radiating elements and a second pair of co-polarized radiating elements. In one example, the first pair of co-polarized radiating elements has a polarization orthogonal to the second pair of co-polarized radiating elements. In one example, the at least one unit cell has a rectangular bounds including four corners within a plane substantially parallel to a reflector of the antenna system, where first and second radiating elements of the first pair of co-polarized radiating elements of the expanded diamond antenna element are disposed in first opposite corners of the four corners across a first diagonal of the rectangular bounds and within the rectangular bounds of the at least one unit cell, and where first and second radiating elements of the second pair of co-polarized radiating elements of the expanded diamond antenna element are disposed in second opposite corners of the four corners across a second diagonal of the rectangular bounds and within the rectangular bounds of the at least one unit cell, which are different to the first opposite corners.

In another example, the present disclosure describes a method that includes arranging quantities and positions of a plurality of unit cells having expanded diamond antenna elements and quantities and positions of at least a second unit cell that does not have an expanded diamond antenna element within an antenna array to provide selected azimuth radiation pattern characteristics via the antenna array.

In still another example, the present disclosure describes a method for an antenna array having at least one unit cell that includes a first expanded diamond antenna element and at least a second unit cell comprising a second expanded diamond antenna element, the second expanded diamond element including a first pair of co-polarized component radiating elements driven from a first RF splitter with first non-equal split ratio vectors and a second pair of co-polarized component radiating elements driven from a second RF splitter with second non-equal split ratio vectors. In one example, the method may include arranging the first non-equal split ratio vectors of the first RF splitter and the second non-equal split ratio vectors of the second RF splitter to provide selected azimuth radiation pattern characteristics.

BRIEF DESCRIPTION OF THE DRAWINGS

The teaching of the present disclosure can be readily understood by considering the following detailed description in conjunction with the accompanying drawings, in which.

To facilitate understanding, identical reference numerals have been used, where possible, to designate identical elements that are common to the figures.

DETAILED DESCRIPTION

Figure 1C:
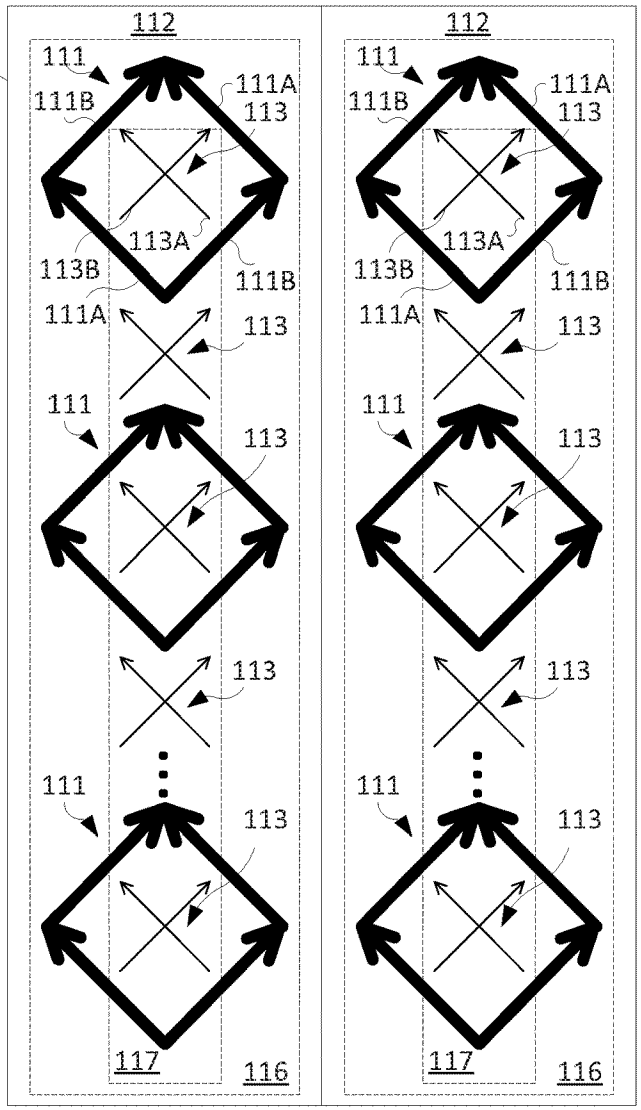
FIGS. 1A-1C illustrate example multi-band, multi-port antennas.

The present disclosure provides for control and optimization of the azimuth radiation pattern of a base station antenna array with expanded diamond antenna element unit cells. Base station antenna arrays are often required to have the half power beamwidth of the radiated radio frequency (RF) power to be around 65 degrees (+/−65 degrees from boresight in azimuth). Towards the +/−60 degrees radiation pattern angle bearings, the RF power is preferred to roll off at a rate that minimizes adjacent cell interference. A vertical column array of unit cells is proposed where each unit cell has a dual-polarized antenna element and where at least one unit cell contains a dual-polarized antenna element configured as an expanded diamond antenna element. The expanded diamond antenna element is made up of two pairs of co-polarized driven component radiating elements, the respective pairs of component radiating elements being orthogonally polarized to each other, and the component radiating elements of each pair being positioned in diametrically opposite corners of a unit cell. The separation between component radiating elements creates an array factor in the azimuth plane. When the vertical array of unit cells is driven with a combination of dual-polarized expanded diamond antenna elements and conventional dual-polarized antenna elements, the 3 dB beamwidth can be maintained at the required 65 degrees but with a sharper power roll off rate at the +/−60 degree azimuth plane radiation pattern angle bearings compared to an array of unit cells with conventional dual-polarized antenna elements only (for example, cross-dipole antenna elements and/or dual-polarized patch antenna elements). The present disclosure also describes an array topology to enable optimized antenna element packing density, giving better array performance in a smaller size reflector. The present disclosure also includes examples with multiple columns of arrays placed side by side.

As used herein, the terms "antenna" and "antenna array" may be used interchangeably. For consistency, and unless otherwise specifically noted, with respect to any of the antenna arrays depicted the real-world horizon is indicated as left-to-right/right-to-left on the page, and the up/vertical direction is in a direction from the bottom of the page to the top of the page consistent with the text/numerals of the figure.

It should also be noted that although the terms, "first," "second," "third," etc., may be used herein, the use of these terms are intended as labels only. Thus, the use of a term such as "third" in one example does not necessarily imply that the example must in every case include a "first" and/or a "second" of a similar item. In other words, the use of the terms "first," "second," "third," and "fourth," do not imply a particular number of those items corresponding to those numerical values. In addition, the use of the term "third" for example, does not imply a specific sequence or temporal relationship with respect to a "first" and/or a "second" of a particular type of item, unless otherwise indicated.

Additional spectrum bands have been released in recent years, and cellular operators have been deploying new radio access technologies to meet subscriber traffic demands. Not only does the antenna system need to support multiple bands operating over a very large bandwidth (for example, low band (LB), e.g., 617-960 MHz, and high band (HB), e.g., 1.4-2.7 GHz), the antenna system needs to have good radiation properties with good isolation. Dual-polarized antenna elements driven via two independent RF ports are widely used in mobile communication as a diversity technique to help mitigate radio channel fading. In order to meet the growing mobile data demand, more and more antenna elements operating at similar, and at different frequency bands of operation are packed onto a single antenna reflector. To further enhance network capacity, advance radio systems such as Long-Term Evolution-Advanced (LTE-A) may use multiple input multiple output (MIMO) antenna system where two dual-polarized antenna array columns of the LB and two dual-polarized antenna array columns of the HB are packed together for connection to a four transmit, four receive (4T4R) base station radio unit for LB and for connection to a 4T4R radio for HB. In general, N/2 number of dual-polarized antenna arrays can be grouped together to enable an NTNR system for each band.

Figure 1B:
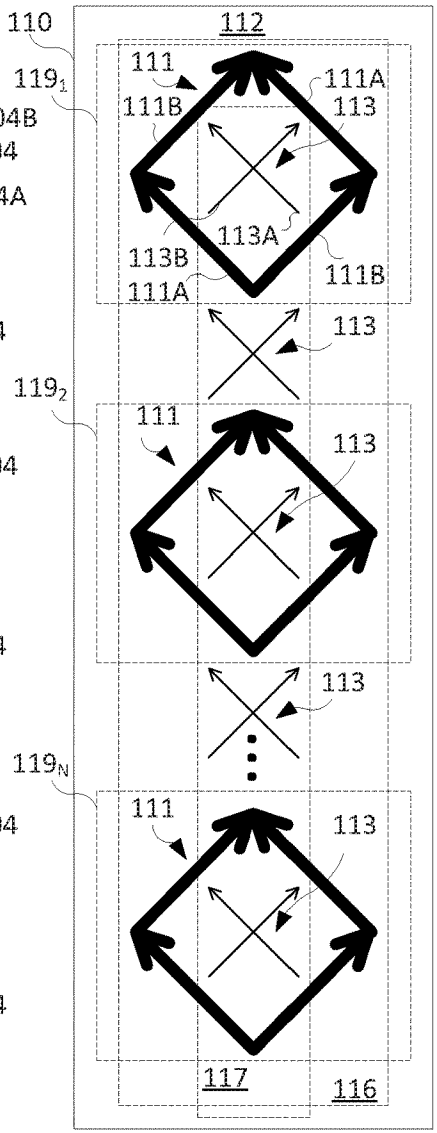
Figure 1A:
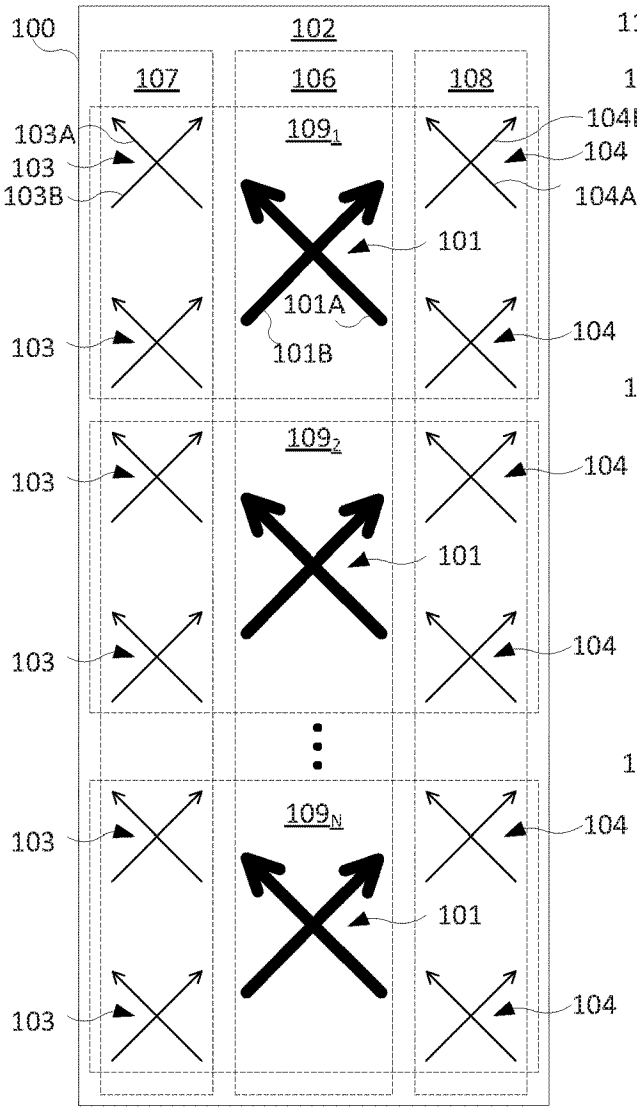

FIGS. 1A-1C show example multi-band, multi-port antennas. FIG. 1A depicts a common triple array configuration with a base station antenna 100 comprising a series of N unit cells $\mathbf{109}_1$ to $\mathbf{109}_N$, which are configured to make up three dual-polarized antenna arrays 106, 107 and 108 positioned over a reflector 102. The first is a LB dual-polarized antenna array 106 and is designed for operation in a LB range of RF frequencies. Next is a first HB dual-polarized antenna array 107 and lastly is a second HB dual-polarized antenna array 108, which are both designed for operation in a HB range of RF frequencies. Each unit cell $\mathbf{109}_1$ to $\mathbf{109}_N$ comprises a larger LB dual-polarized antenna element 101 for the LB dual-polarized antenna array 106, two HB dual-polarized antenna elements (each element as 103) for the first HB dual-polarized antenna array 107, and two HB dual-polarized antenna elements (each element as 104) for the second HB dual-polarized antenna array 108. The vertical distance between HB dual-polarized antenna elements, or pitch, is typically half of the pitch of the LB dual-polarized antenna elements 101. In this triple dual-polarized column antenna array, the LB dual-polarized antenna array 106 is typically positioned in the center of the reflector 102. This configuration is also commonly referred to as a "side-by-side" base station antenna configuration.

The LB dual-polarized antenna element 101 may comprise a radiating element 101A such as a dipole which has a slant polarization at +45 degrees and an orthogonally polarized radiating element 101B which has a slant polarization at −45 degrees. Each of the LB dual-polarized antenna elements, or "unit cells" $\mathbf{109}_1$-$\mathbf{109}_N$ are distributed along the length of the reflector 102 at a prescribed pitch that is tuned to optimize for directivity, elevation radiation main beam tilt range and elevation radiation pattern sidelobe performance. The first HB dual-polarized antenna array 107 also comprises +45 degree polarized and −45 degree polarized radiating elements 103A and 103B respectively. The second HB dual-polarized antenna array 108 also comprises +45 degree polarized and −45 degree polarized radiating elements 104A and 104B respectively.

FIG. 1B depicts a "dual-in-line" base station antenna configuration. The antenna 110 comprises a reflector 112 and two co-axial dual-polarized antenna array columns; a LB dual-polarized antenna array 116 operating at a LB frequency range, and a HB dual-polarized antenna array 117 operating at a HB frequency range. In this configuration, the LB dual-polarized antenna elements 111 are made up of a pair of +45 degree polarized LB radiating elements 111A and a pair of −45 degree polarized LB radiating elements 111B. Each radiating element within a pair of radiating elements is driven with equal phase and amplitude. The co-polarized radiating elements of each pair are typically arranged in close proximity to each other, making use of their mutual coupling to improve the input impedance match of the LB dual-polarized antenna array 116 over a large bandwidth. This arrangement of the LB dual-polarized radiating element pairs 111A and 111B may be referred to as a "diamond antenna element". Conventional HB dual-polarized antenna elements 113 comprising orthogonal radiating elements 113A and 113B may then be deployed within the diamond antenna element comprising LB dual-polarized radiating element pairs 111A and 111B. A LB dual-polarized diamond antenna element 111 and a conventional HB dual-polarized antenna element 113 make up a first unit cell $\mathbf{119}_1$. Since the pitch of the HB dual-polarized antenna array 117 is smaller than the pitch of the LB dual-polarized antenna array 116, additional HB dual-polarized antenna elements 113 may be positioned in between unit cells containing a diamond antenna element along the vertical length of the reflector 112.

To achieve a 4T4R antenna configuration, the antenna array topology in FIG. 1B is duplicated and placed side by side as shown in the antenna 120 of FIG. 1C. This may be referred to as a "double wide" antenna system.

Cellular base station sites are typically designed and deployed with three sectors arranged to serve different azimuth bearings, for example each sector serving a 120° range of angle from a cell site location. Each sector may comprise an antenna with an azimuthal radiation pattern which defines the sector coverage footprint. The half power beamwidth (HPBW) of the azimuth radiation pattern of a base station sector antenna is generally optimal at around 65°, to provide cellular service coverage with a minimal number of tri-sectored base station sites.

Most mobile data cellular network access technologies including Long Term Evolution (LTE) employ 1:1 or full spectrum re-use schemes in order to maximize spectral efficiency and capacity. This aggressive spectral re-use implies that inter-sector and inter-cell interference needs to be minimized so that spectral efficiency can be maximized. Antenna tilting, normally delivered by electrical phased array beam tilt, provides a network optimization freedom to address inter-cell interference, but few options exist to optimize inter-sector interference. The front-to-back (FTB), front-to-side (FTS) and sector power ratio (SPR) of an antenna pattern are figures of merit which indicate the amount of inter-sector interference; the larger the FTB and FTS and the lower the SPR value, the lower the inter-sector interference.

Figure 2:
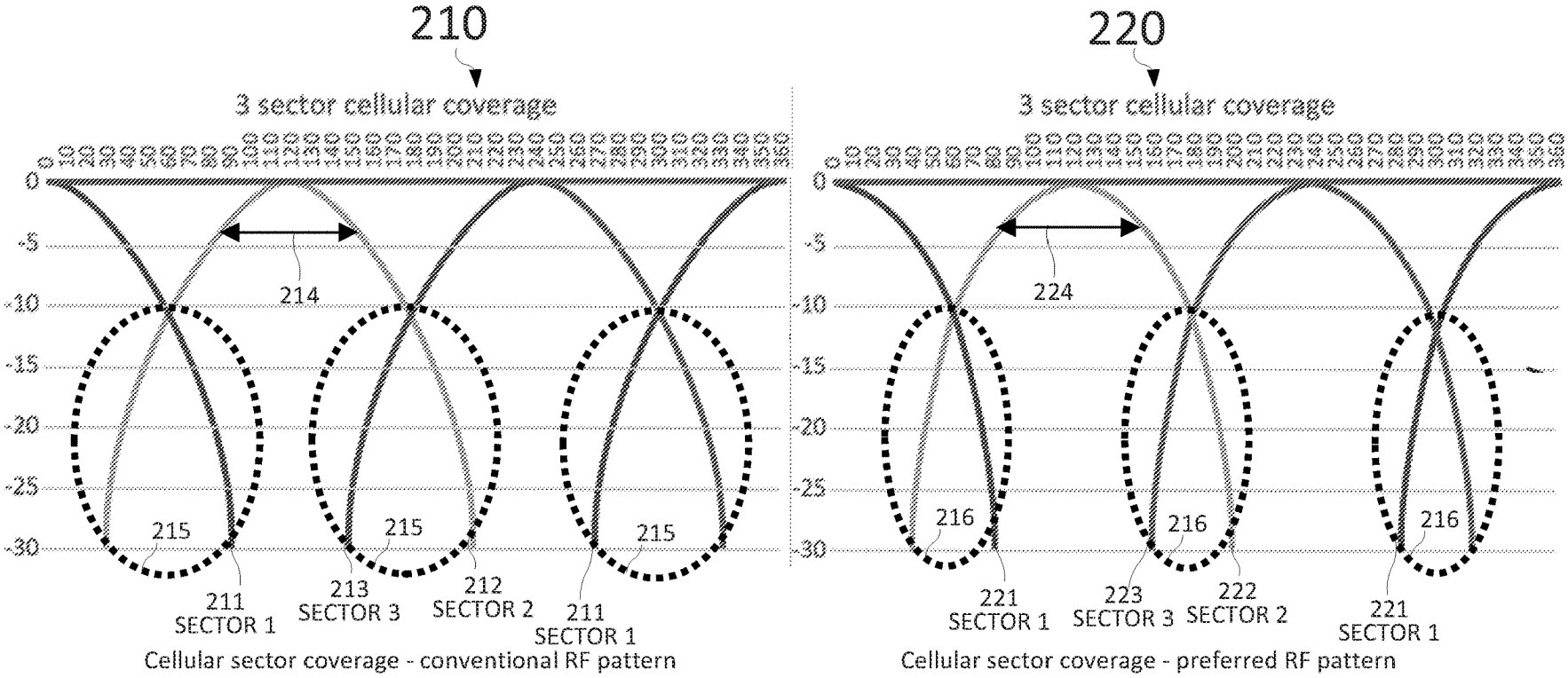
FIG. 2 illustrates conventional and optimized azimuthal radiation patterns for a three-sector cellular base station site.

FIG. 2 shows a graph 210 of the azimuthal radiation patterns of a 3-sector cellular base station site. The radiation patterns 211, 212, 213 have boresight bearings at 0 degrees (211), 120 degrees (212), and 240 degrees (213), The 3 dB beamwidth or HPBW of each sector is defined as 214, typically around 65 degrees across all frequencies in the prescribed band. To ensure optimal inter-site tessellation of coverage between multiple 3-sector base station sites, it can be shown that the adjacent sector radiation pattern should cross-over at the +/−60 degrees bearings at around the −10 dB level relative to the main beam. With conventional dual-polarized antenna elements over a common ground plane/reflector (e.g., as shown in FIG. 1A), the radiation pattern will begin to broaden at and beyond the +/−60 degrees bearings from each beam peak, thus giving a larger overlap region 215 between each sector. This increase in overlap can cause an increase in inter-sector interference, and hence an undesirable reduction in spectral efficiency.

FIG. 2 also illustrates a graph 220 of the optimized azimuthal radiation patterns (221, 222, 223). Firstly, each sector's RF power maintains a 3 dB beamwidth 224 and a 10 dB sector cross-over level, and hence similar to the antenna azimuth radiation patterns shown in graph 210. Secondly, beyond the +/−60 degrees bearings from each beam peak, the RF power roll-offs are sharper to minimize the overlap between each sector 216. This can be seen comparing the area under 215 and 216, where 216 is a preferred radiation pattern with less overlap.

In a base station antenna array design, such as in FIG. 1A, a single antenna array column (106, 107, or 108) based on dipoles or patch will only achieve around an SPR of 7-8%. This is similar to the patterns shown in graph 210. In order to achieve the more aggressive azimuth roll-off patterns (beyond +/−60 degrees bearings) of graph 220, an additional dual-polarized antenna element in the azimuth plane of the reflector 102 can be added to one or more of the unit cells. An example is shown in FIG. 3.

Figure 3:
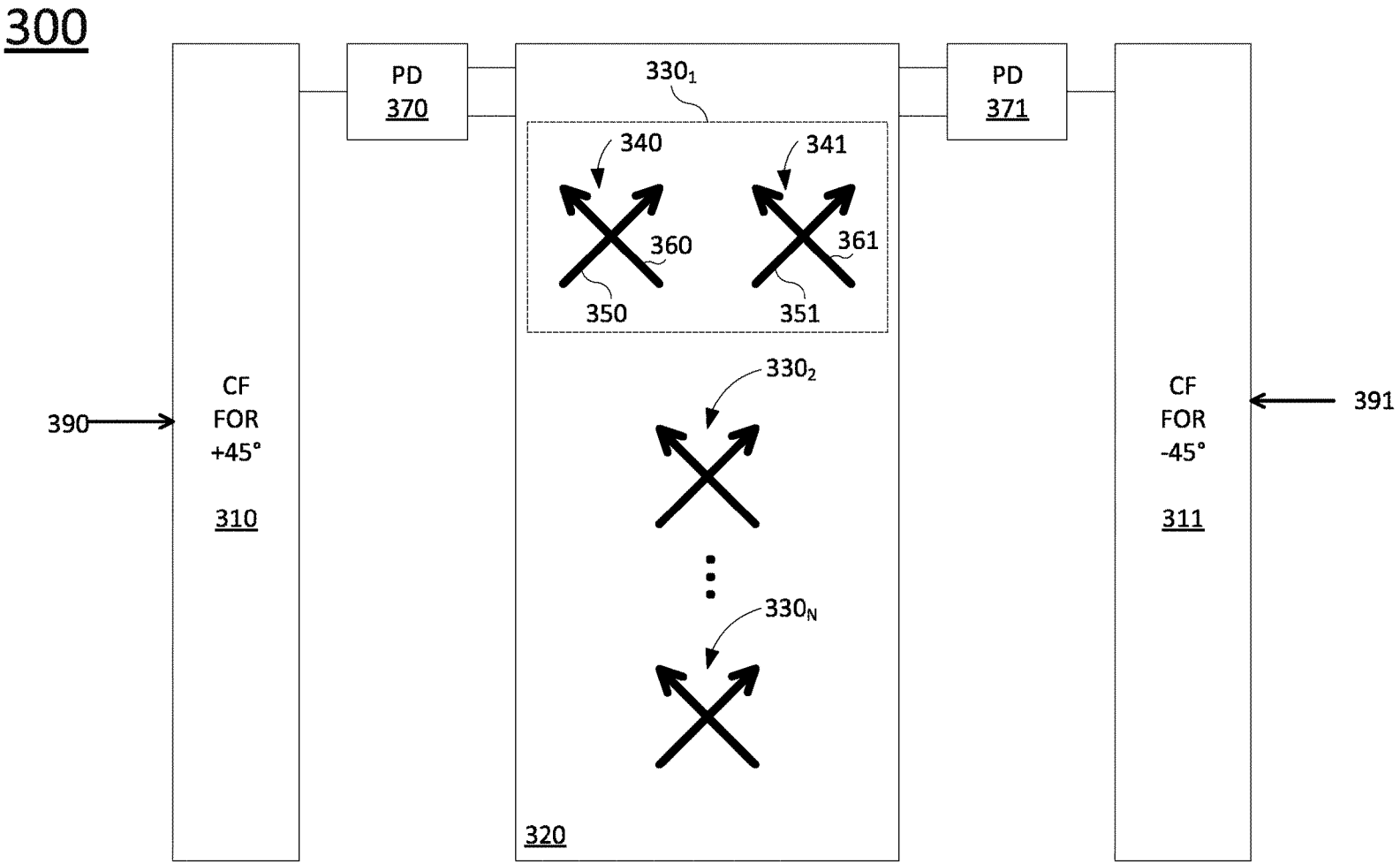
FIG. 3 illustrates an example antenna system.

For example, FIG. 3 illustrates an antenna system 300 comprising an array of N unit cells where a first unit cell $\mathbf{330}_1$ has a pair of dual-polarized antenna elements 340, 341, whereas the other unit cells $\mathbf{330}_2$ to $\mathbf{330}_N$ only have one dual-polarized antenna element each. A first RF signal is connected to a first input 390 of a first corporate feed (CF) network 310 providing component signals for the +45 degree polarized radiating elements of the array of dual-polarized antenna elements. A second RF signal is connected to a second input 391 of a second CF network 311 providing component signals for the −45 degree polarized radiating elements of the array of dual polarized antenna elements. A first RF splitter or power divider 370 connects to the two +45 degree polarized radiating elements 360 and 361 of the two dual-polarized antenna elements 340 and 341 of the first unit cell $\mathbf{330}_1$. A second RF splitter or power divider 371 connects to the two −45 degree polarized radiating elements 360 and 361 of the dual-polarized antenna elements of the first unit cell $\mathbf{330}_1$. The RF power split and phase split of power dividers 370 and 371 are typically equal for both co-polarized pairs of radiating elements. The dual-polarized antenna element pair configuration, depending on the separation of the antenna elements, gives an array factor in the azimuth plane to narrow the beamwidth at the level around the +/−60 degrees bearings in the azimuth radiation pattern. The more unit cells which are converted into a pair of driven dual-polarized antenna elements, the narrower the beamwidth and steeper the azimuth pattern roll off. It should be noted that each sector ideally should maintain a cross over point at around −10 dB with the adjacent sector to ensure optimal tessellation of cells in a cellular network design. However, the antenna reflector 320 is now nearly doubled its original width (e.g., as compared to reflector 102 of FIG. 1A) since an additional element is duplicated. This means that practical deployment factors such as wind loading will deteriorate, along with higher material cost and weight of the antenna.

Figure 4:
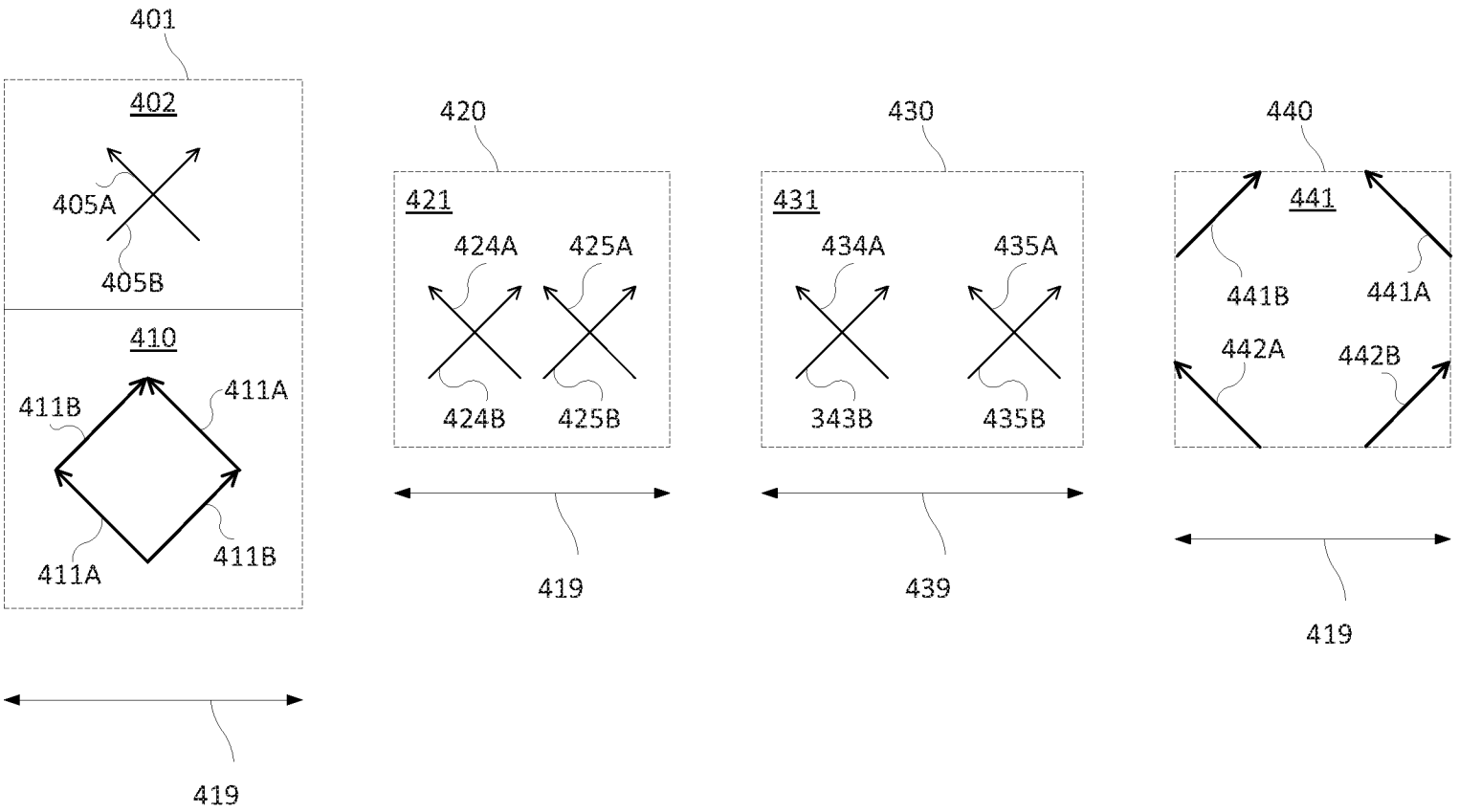
FIG. 4 illustrates antenna arrays with unit cells having cross-dipole antenna elements, diamond unit cells, and expanded diamond antenna elements, according to the present disclosure.

The present disclosure describes the use of split diamond antenna elements and unit cells to generate an azimuth array factor and to improve on the SPR parameter of the antenna, without the need to increase the reflector width dimension. FIG. 4 illustrates a first antenna array 401 having a unit cell 402 with a single dual-polarized antenna element 405A and 405B, and a unit cell 410 (e.g., a "diamond unit cell") where a pair of +45 degree radiating elements 411A and a pair of −45 degree radiating elements 411B comprise a dual-polarized antenna element (e.g., a LB diamond antenna element), over a reflector dimension 419. FIG. 4 also illustrates an antenna array 420 where the dual-polarized antenna element of unit cell 402 is duplicated (424A, 424B and 425A, 425B) but constrained to fit within the same reflector dimension 419 shown as unit cell 421. The close proximity of the two dual-polarized antenna elements 424A, 424B and 425A, 425B (e.g., being less than half a wavelength separation) results in mutual coupling issues affecting the performance of the antenna system. In order to improve the mutual coupling effects, the two dual-polarized antenna elements 424A, 424B and 425A, 425B may be separated further. For instance, this is shown in antenna array 430 comprising unit cell 431 having two dual-polarized antenna elements 434A, 434B and 435A, 435B, which results in an increase of the reflector's width 439.

The LB diamond antenna element of unit cell 410 has the advantage of allowing collocation of HB dual-polarized antenna element(s), where the HB dual-polarized antenna array can be deployed without mutual obstruction with the LB dual-polarized antenna array. In addition, the driven pairs of +45 degree and −45 degree radiating elements are located closely together to enable sufficient mutual coupling to enhance bandwidth and isolation performance. However, the separation of the phase center of the co-polarized radiating element pairs is insufficient to set up an array factor where azimuth beamwidth and SPR can be effectively controlled.

In contrast, as shown in antenna array 440, examples of the present disclosure place the component radiating elements of each of the two co-polarized radiating element pairs in opposite corners of the unit cell 441. In particular, the unit cell 441 has a bounds of substantially rectangular dimensions including four corners, e.g., within a plane substantially parallel to a reflector of the antenna system. First and second radiating elements 441A and 441B of the first pair of co-polarized radiating elements of the expanded diamond antenna element are disposed in first diametrically opposite corners of the four corners within the bounds of the unit cell 441, and first and second radiating elements 442A and 442B of the second pair of co-polarized radiating elements of the expanded diamond antenna element are disposed in second diametrically opposite corners of the four corners within the bounds of the unit cell 441. Maximizing separation of co-polarized radiating elements minimizes mutual coupling of the co-polarized radiating element pairs, and at the same time maintains reflector width dimensions. It can be seen that the width of the reflector can be maintained as 419, and can be shown to provide an azimuth array factor which will improve SPR. In other words, the co-polarized radiating elements 441A and 442A are moved to the upper right and lower left corner of the unit cell perimeter, while the co-polarized radiating elements 441B and 442B (which may be orthogonally polarized to 441A and 442A) are moved to the upper left and lower right corner of the unit cell perimeter. This is referred to in this disclosure as an "expanded diamond antenna element".

It should be noted if all unit cells in an antenna array were to comprise expanded diamond antenna elements, then the performance of the antenna array may be degraded due to strong mutual coupling between the expanded diamond antenna elements (e.g., adjacent unit cell coupling). However, if expanded diamond antenna elements are alternated with conventional dual-polarized antenna elements such as shown in unit cell 402, then the mutual coupling between unit cells may be minimized, in addition to offering an improvement in SPR while maintaining the overall antenna width.

Figure 5:
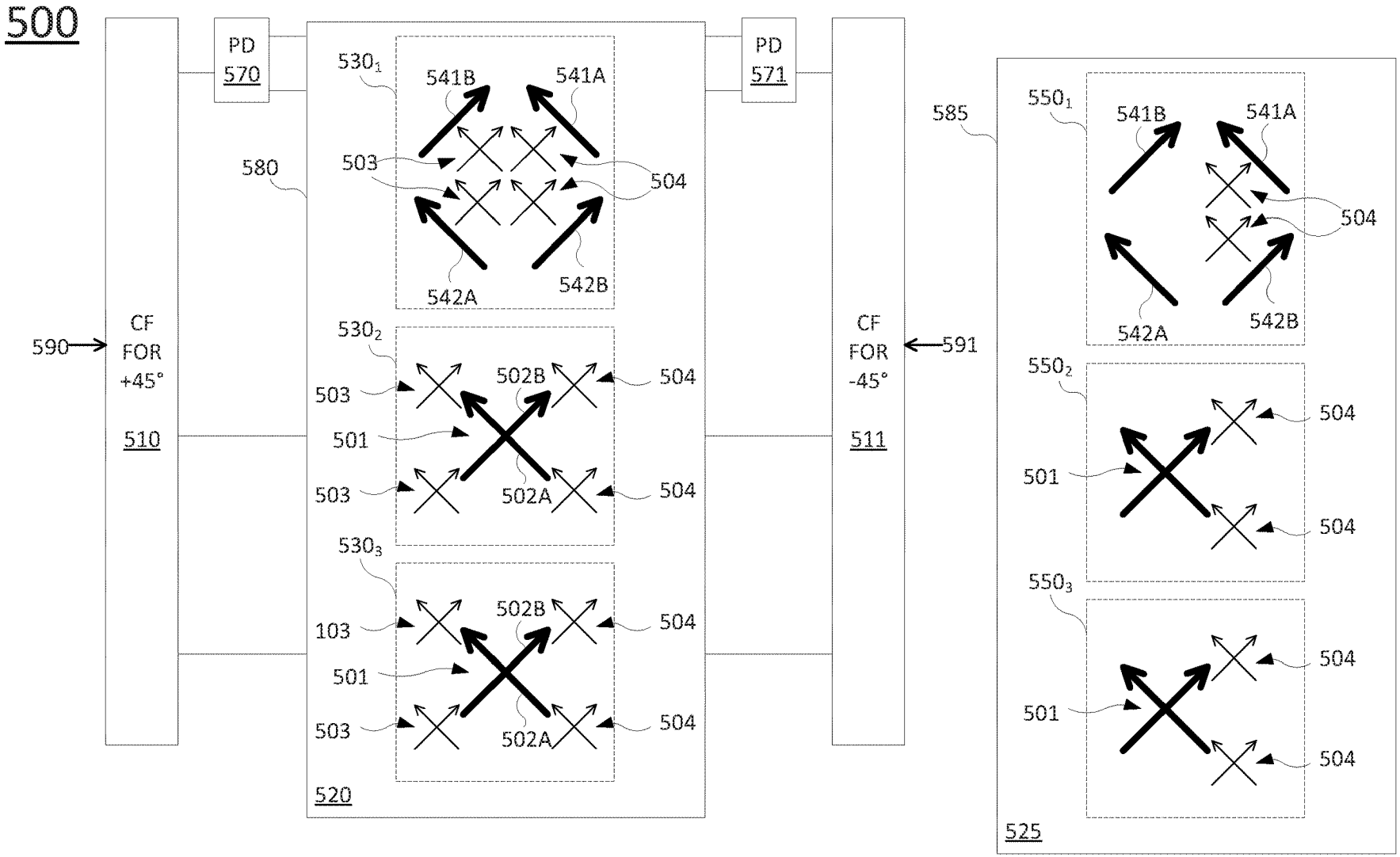
FIG. 5 illustrates an antenna system where an antenna array includes an expanded diamond antenna element, according to the present disclosure.

FIG. 5 shows a first example antenna system 500 of the present disclosure where an antenna array 580 includes a plurality of unit cells $530_1$-$530_3$ deployed on a common reflector 520, for operation in a LB range of frequencies, which has a reflector width substantially similar to the reflector width of an antenna array with a single column array as previously shown in FIG. 1A. A first unit cell $530_1$ has a first pair of co-polarized radiating elements 541A and 542A positioned diagonally across from each other in opposite corners of the nominally square or rectangular unit cell perimeter. The first unit cell $530_1$ also has a second pair of co-polarized radiating elements 541B and 542B positioned diagonally across from each other in opposite corners of the nominally square or rectangular unit cell perimeter; the second pair of co-polarized radiating elements 541B and 542B are polarized orthogonally to and in different corners to the first pair of co-polarized radiating elements 541A and 542A. The two pairs of LB co-polarized radiating elements (541A, 542A and 541B, 542B) form an expanded diamond antenna element. The position and separation of the co-polarized radiating element pairs (541A, 542A and 541B, 542B) can be adjusted in the azimuth plane within the width of the reflector 520 to fine tune SPR. The position and separation of the co-polarized radiating element pairs (541A, 542A and 541B, 542B) can also be adjusted in the vertical plane to fine tune radiated elevation pattern down tilt range and upper elevation radiation pattern side lobe levels.

In one example, each of the two LB co-polarized radiating element pairs (541A, 542A and 541B, 542B) of the first unit cell are fed by an equal amplitude and co-phase RF splitter or power divider 570 and 571 via respective corporate feed networks 510 and 511 which process respective input signals 590 and 591. In one example, four conventional HB dual-polarized antenna elements (two of 503 and two of 504) can be placed in the central region between the two pairs of LB co-polarized radiating elements (541A, 542A and 541B, 542B) making up the expanded diamond antenna element. Unit cell 2 ($530_2$) and unit cell 3 ($530_3$) each comprise a conventional dual-polarized LB antenna element 501 with orthogonally polarized dipole radiating elements 502A and 502B. Unit cell 2 ($530_2$) and unit cell 3 ($530_3$) also each comprise conventional HB dual-polarized antenna elements (two of 503 and two of 504) arranged as illustrated. The combined array factor of unit cells $530_1$-$530_3$ gives an overall SPR improvement of the array while maintaining a preferred HPBW of 65 degrees.

FIG. 5 also shows a second example of the present disclosure where an antenna array 585 includes a first unit cell $550_1$ in which two conventional HB dual-polarized antenna elements (two of 504) are positioned inside the LB expanded diamond antenna element made up of the two pairs of LB co-polarized radiating elements (541A, 542A, 541B, 542B), where the pairs are orthogonally polarized to each other to form the first unit cell $550_1$. A second and a third unit cell $550_2$ and $550_3$ each comprise a LB dual-polarized antenna element 501, off-center from a center of the reflector 525 and adjacent to two HB dual-polarized antenna elements (two of 504). In this approach, the reflector 525 can have the same width similar to FIG. 1B or have a reduced width since only one array of HB dual-polarized antenna elements is used. It should be noted that in other, further, and different examples, the examples of FIG. 5 may be expanded or modified to comprise an array of N number of unit cells with different configurations of LB dual polarized antenna elements such as conventional dual-polarized antenna elements, (non-expanded) diamond antenna elements, expanded diamond antenna elements, and dual-polarized displaced radiating element pairs, for example.

It should be noted that as referred to herein, a unit cell may comprise a grouping of any one or more antenna elements for any one or more antenna arrays of an antenna system sharing a reflector, an antenna radome, and/or a common backplane, having substantially rectangular dimensions and including four corners within a plane substantially parallel to the reflector, the antenna radome, and/or the common backplane, and where at least two unit cells occupy the length of the reflector, the antenna radome and/or the common backplane. A unit cell can include one or multiple antenna elements for any particular array. In addition, as referred to herein, an antenna element may comprise any one or more radiating elements intended to occupy a particular position in an antenna array comprising a plurality of antenna elements. Antenna elements can include conventional dual-polarized radiating elements (e.g., a +45/−45 degree cross-dipole, a V/H oriented cross-dipole, a dual-polarized patch antenna, etc.), a diamond antenna element, an "H" shaped or "dog bone" shaped antenna element (e.g., with two split vertical radiating elements and a horizontal radiating element), a split diamond antenna element, antenna elements comprising dual-polarized displaced radiating element pairs, and so forth.

Figure 6:
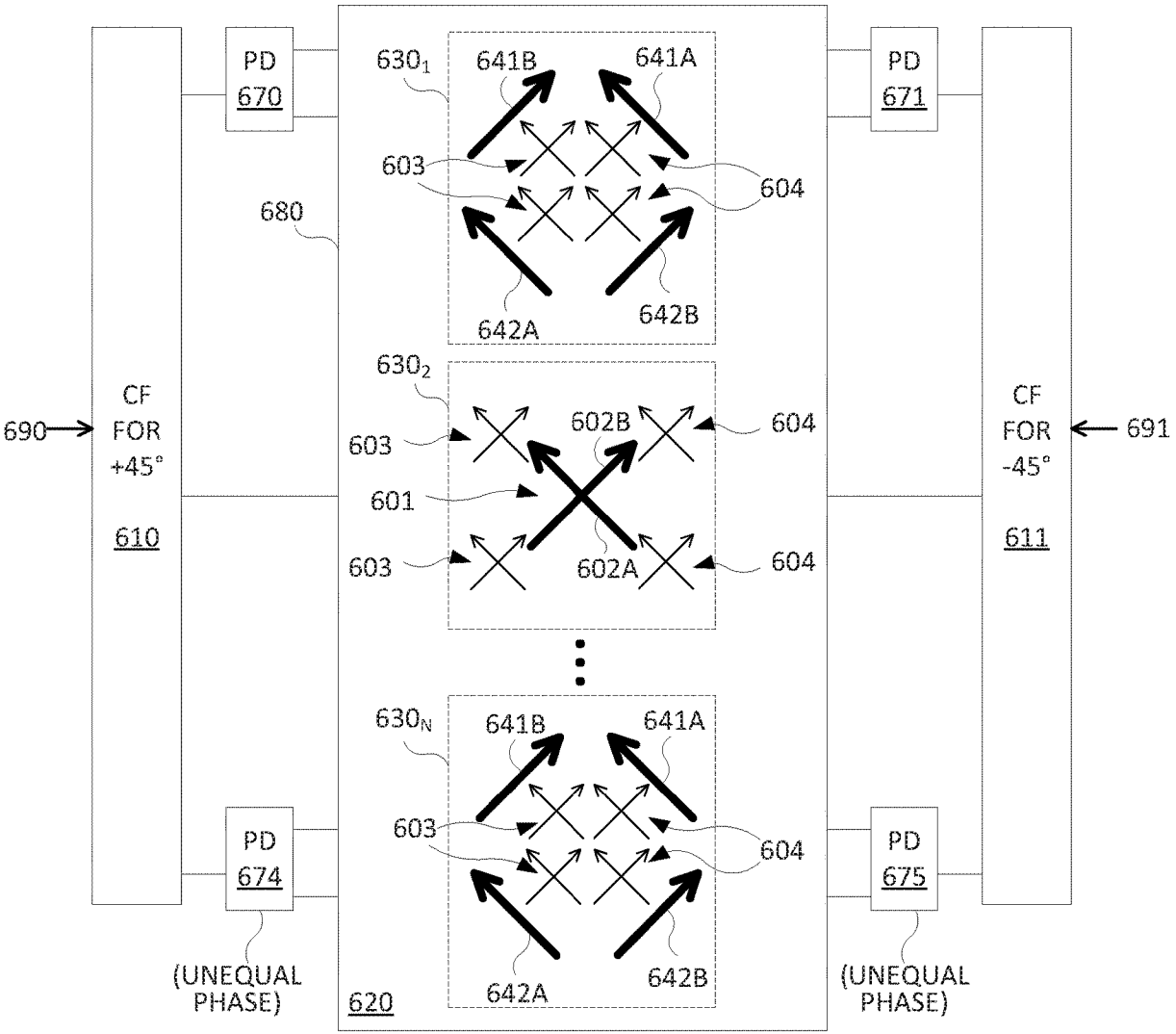
FIG. 6 illustrates an example antenna system where both a first and third unit cell contain an expanded diamond antenna element, according to the present disclosure.

To reduce the effect of mutual coupling, the unit cells containing the LB expanded diamond antenna elements can be alternated with unit cells containing conventional LB dual-polarized antenna elements. FIG. 6 shows a third example to further improve the SPR where both a first and third unit cell contain an expanded diamond antenna element. As illustrated in FIG. 6, an antenna system 600 includes an antenna array 680 comprising a plurality of unit cells $\mathbf{630}_1$-$\mathbf{630}_3$ deployed on a common reflector 620. The antenna system 600 is similar to the antenna system 500 of FIG. 5 and includes a first unit cell $\mathbf{630}_1$ having a first pair of co-polarized radiating elements 641A and 642A and a second pair of co-polarized radiating elements 641B and 642B which are orthogonal to the first pair of co-polarized radiating elements 641A and 642A. In one example, each of the two LB co-polarized radiating element pairs (641A, 642A and 641B, 642B) of the first unit cell $\mathbf{630}_1$ are fed by an equal amplitude and co-phase RF splitter or power divider 670 and 671 via respective corporate feed networks 610 and 611 which process respective input signals 690 and 691. The first unit cell $\mathbf{630}_1$ also includes four conventional HB dual-polarized antenna elements (two of 603 and two of 604) placed in the central region between the two pairs of LB co-polarized radiating elements (641A, 642A and 641B, 642B) making up the expanded diamond antenna element. Unit cell 2 ($\mathbf{630}_2$) comprises a conventional dual-polarized LB antenna element 601 with orthogonally polarized dipole radiating elements 602A and 602B. Unit cell 2 ($\mathbf{630}_2$) also comprises conventional HB dual-polarized antenna elements (two of 603 and two of 604) arranged as illustrated.

If greater elevation plane beam tilts are required, then conventional antenna arrays may experience beam squint in the azimuth plane at large tilt angles. Squint denotes a deviation of a main beam from boresight direction. For example, a +45 degree mainbeam may be distorted in the positive angle direction in azimuth, while a −45 degree mainbeam may be distorted in the negative angle direction in azimuth. However, examples of the present disclosure may offset this azimuth plane squint by driving each pair of the co-polarized radiating elements (641A, 642A and 641B, 642B) of the last $N^{th}$ unit cell $\mathbf{630}_N$ with a non-equal amplitude and/or non-equal phase RF splitter or power divider 674 and 675, respectively. The offset in phase and/or amplitude creates a natural squint in the azimuth plane that at minimum tilt angles may be considered insignificant, but at maximum tilt angles, the co-polarized antenna elements provide a pre-distortion to help realign the azimuth radiation patterns and hence minimize squint.

Figure 7:
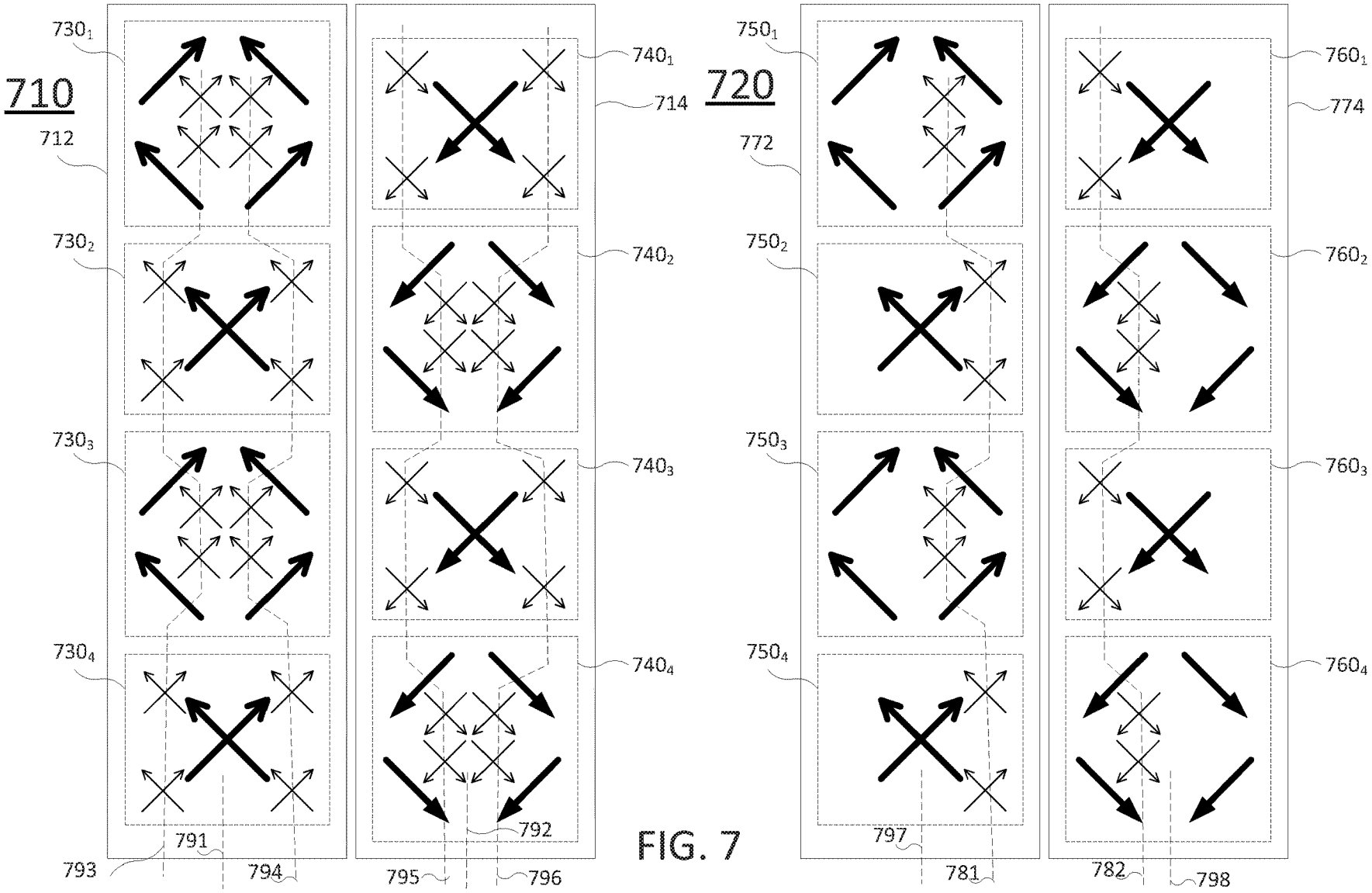
FIG. 7 illustrates antenna systems with side-by-side arrays comprising unit cells containing LB expanded diamond antenna elements alternated with unit cells containing conventional LB dual-polarized antenna elements, according to the present disclosure.

The fourth example of the present disclosure is depicted in FIG. 7 where the antenna systems described in the first example or in the third example can be placed in a side-by-side configuration to create a larger array of unit cells. The antenna array 710 of FIG. 7 includes unit cells containing LB expanded diamond antenna elements $\mathbf{730}_1$, $\mathbf{730}_3$, $\mathbf{740}_2$, and $\mathbf{740}_4$ alternated with unit cells containing conventional LB dual-polarized antenna elements $\mathbf{730}_2$, $\mathbf{730}_4$, $\mathbf{740}_1$, and $\mathbf{740}_3$. The antenna array 710 specifically shows an example of two reflectors 712 and 714 placed side by side. The left reflector 712 is for one LB dual-polarized antenna array 791 and two dual-polarized HB arrays 793 and 794. The first and third unit cells $\mathbf{730}_1$ and $\mathbf{730}_3$ each comprise expanded diamond antenna elements, and the second and fourth unit cells $\mathbf{730}_2$ and $\mathbf{730}_4$ each comprise conventional LB dual-polarized antenna elements. The right reflector 714 is for one LB dual-polarized antenna array 792 and two HB dual-polarized antenna arrays 795 and 796. The first and third unit cells $\mathbf{740}_1$ and $\mathbf{740}_3$ each comprise a conventional LB dual-polarized antenna element, while the second and fourth unit cells $\mathbf{740}_2$ and $\mathbf{740}_4$ each comprise a LB expanded diamond antenna element. This configuration ensures that no expanded diamond antenna element is positioned directly adjacent to another expanded diamond antenna element which may otherwise cause excessive mutual coupling and degrade the array performance. The HB dual-polarized antenna elements of HB dual-polarized antenna arrays 793-796 may be arranged similar to the description as per antenna array 580 of FIG. 5 and antenna array 680 of FIG. 6.

It should be noted that the radiating elements of reflector 712 are illustrated as arrows pointing generally upward, while the radiating elements of reflector 714 are illustrated as arrows pointing generally downward. The directionality of the arrows signifies the phase relationship between signals associated with the respective radiating elements. For instance, signals for radiating elements of reflector 712 may be co-phased, while signals for radiating elements of reflector 714 may also be co-phased with each other, but may be out-of-phase with signals for radiating elements of reflector 712. This arrangement may provide isolation between arrays on reflector 712 and arrays on reflector 714. For instance, radiating elements of reflector 714 may be 180 degrees out-of-phase (e.g., anti-phased) with radiating elements of reflector 712, or may have a different phase relationship (e.g., 145 degrees out of phase, 185 degrees, out of phase, etc.) which may be tuned in accordance with the separation distances between respective radiating elements of array(s) associated with reflector 712 and array(s) associated with reflector 714.

In order to reduce the size of the reflector, an additional column of HB dual-polarized antenna elements can be removed as described with respect to antenna array 585 in FIG. 5. Antenna array 720 of FIG. 7 shows an example of a side-by-side configuration of this particular arrangement where unit cells containing LB expanded diamond antenna elements ($\mathbf{750}_1$, $\mathbf{750}_3$, $\mathbf{760}_2$, $\mathbf{760}_4$) are alternated with unit cells contain conventional LB dual-polarized antenna elements ($\mathbf{750}_2$, $\mathbf{750}_4$, $\mathbf{760}_1$, $\mathbf{760}_3$) to provide two side-by-size LB arrays 797 and 798 over respective reflectors 772 and 774. HB dual-polarized antenna elements are arranged in two arrays 781 and 782 as illustrated. It should be noted that in other, further, and different examples, the antenna systems of FIG. 7 may be expanded or modified to comprise an antenna system of N number of unit cells with different configurations of LB dual-polarized antenna elements such as conventional LB dual-polarized antenna elements, diamond antenna elements, and expanded diamond antenna elements, for example.

Figure 8:
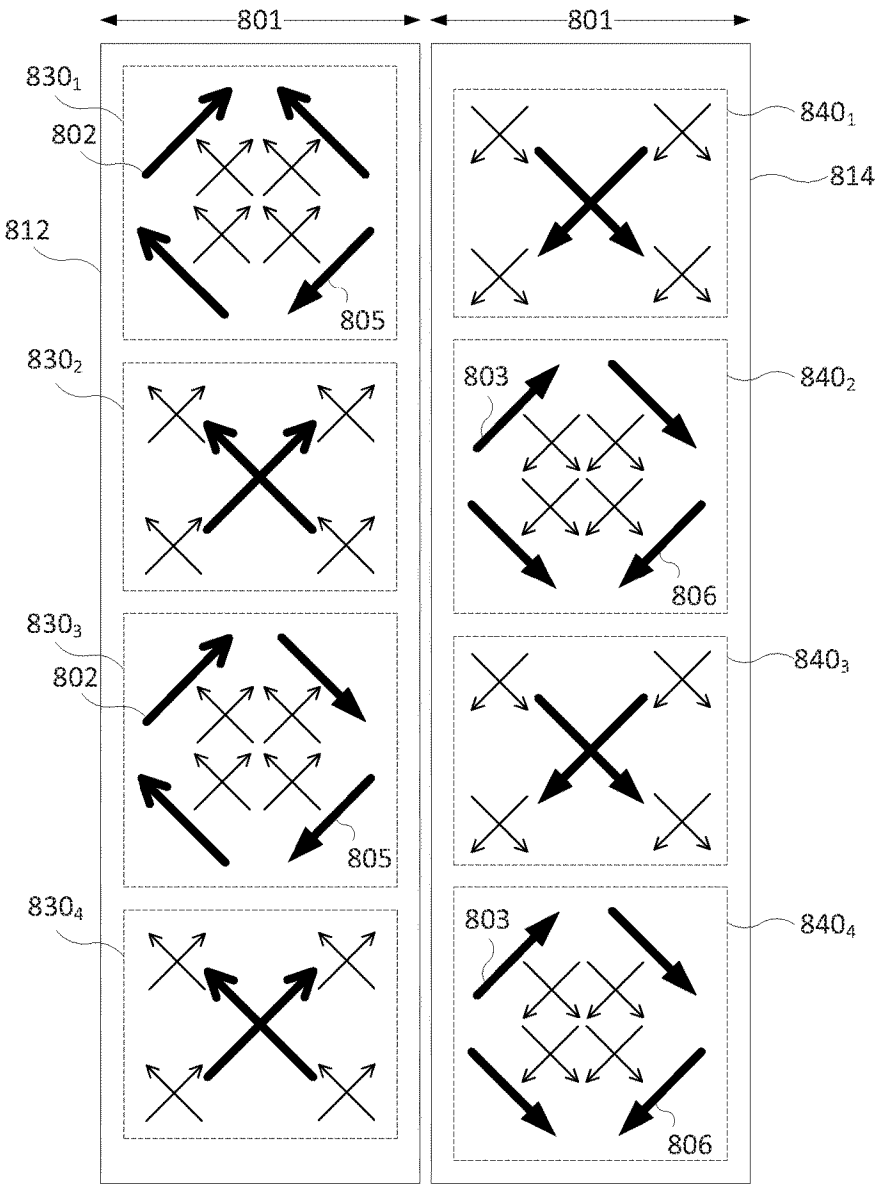
FIG. 8 depicts an antenna system configured in a side-by-side arrangement in which radiating elements are swapped between expanded diamond antenna elements associated with adjacent reflectors, according to the present disclosure.

A fifth example of the present disclosure illustrates an antenna system 800 shown in FIG. 8 which may provide improved SPR when the antenna system is configured in a side-by-side arrangement. In the present example, radiating elements are swapped between expanded diamond antenna elements associated with adjacent reflectors 812 and 814. For example, expanded diamond antenna elements of unit cells $\mathbf{830}_1$ and $\mathbf{830}_3$ may comprise a first pair of +45 degree co-polarized radiating elements 802 and 805, and a second pair of −45 degree co-polarized radiating elements. However, in the present example, radiating elements 803 from unit cells $\mathbf{840}_2$ and $\mathbf{840}_4$ may be substituted for radiating elements 805. The pairs of co-polarized radiating elements 802 and 803 may then be co-fed (e.g., with an equal amplitude and phase power divider and corporate feed such as illustrated in FIG. 5). As shown in FIG. 8, the directionality of the arrows denoting radiating elements 802 and 803 are the same (e.g., generally pointing upward), indicating that the radiating elements 803 are also co-phased with radiating elements 802, whereas the majority of radiating elements associated with reflector 812 have a different phase relationship (e.g., indicated by arrows generally pointing downward). In addition, radiating elements 805 may be now paired with radiating elements 806 to comprise pairs of co-polarized radiating elements associated with unit cells $\mathbf{840}_2$ and $\mathbf{840}_4$. In other words, radiating elements 803 and 805 are swapped in position. The pairs of co-polarized radiating elements 805 and 806 may be similarly co-fed. In addition, the directionality of the arrows denoting radiating elements 805 and 806 are the same (e.g., generally pointing downward), indicating that the radiating elements 805 are also co-phased with radiating elements 806, whereas the majority of radiating elements associated with reflector 814 have a different phase relationship (e.g., indicated by arrows generally pointing upward). This improves the azimuth array factor, and therefore also improves the overall antenna SPR performance. Radiating elements in similar layout can be swapped in a similar way to achieve a narrower beamwidth array factor.

Figure 9:
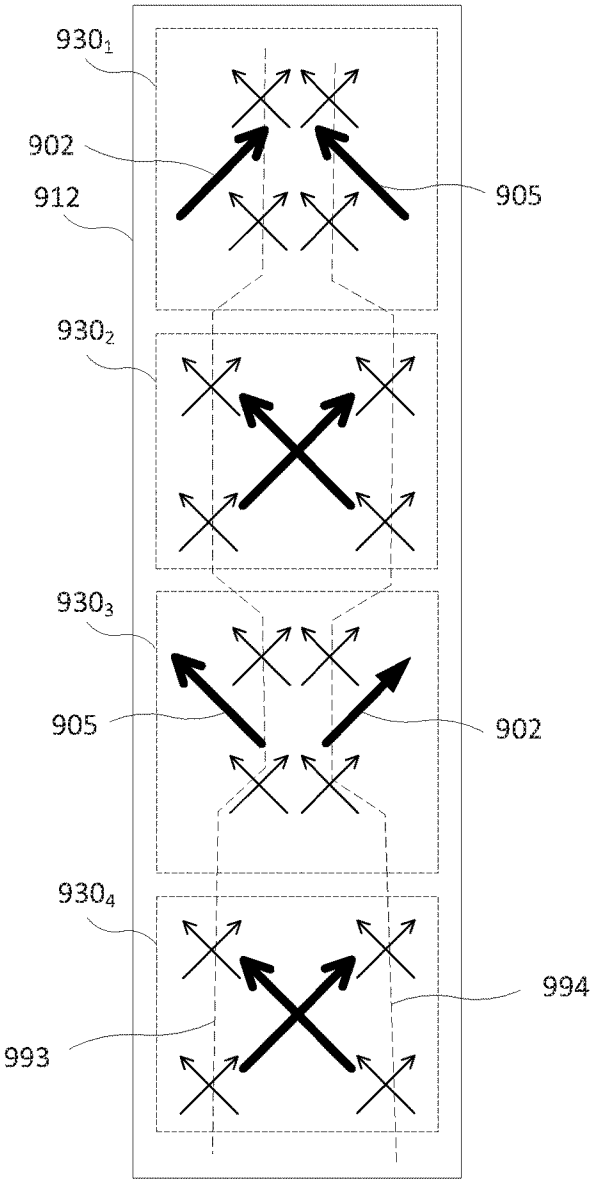
FIG. 9 illustrates an antenna system with unit cells containing LB dual-polarized displaced radiating element pairs alternated with unit cells containing conventional LB dual-polarized antenna elements.

FIG. 9 illustrates a sixth example of the present disclosure in which an antenna system 900 comprises an array of unit cells $\mathbf{930}_1$-$\mathbf{930}_4$ positioned linearly over a reflector 912. The antenna system 900 includes two dual-polarized HB arrays 993 and 994 as illustrated. Within the unit cells $\mathbf{930}_1$-$\mathbf{930}_4$, the positions of the dual-polarized HB radiating elements of dual-polarized HB arrays 993 and 994 are similar to those illustrated in the example of antenna array 710 of FIG. 7, and/or as illustrated in either of the side-by-side arrays of antenna system 800 of FIG. 8. In the example of FIG. 9, unit cells $\mathbf{930}_1$ and $\mathbf{930}_3$ include LB antenna elements comprising LB dual-polarized displaced radiating element pairs. For instance, a LB dual-polarized displaced radiating element pair may comprise respective ones of orthogonally polarized radiating elements 902 and 905. In other words, a single polarity radiating element (902 and 905, respectively) is each placed on the edge of the reflector 912. Unit cells $\mathbf{930}_1$ and $\mathbf{930}_3$ are alternated with unit cells $\mathbf{930}_2$ and $\mathbf{930}_4$ that include conventional LB dual-polarized antenna elements.

It should be noted that radiating elements of each LB dual-polarized displaced radiating element pair can be placed on either side of the reflector 912 within any given unit cell in which such an LB dual-polarized displaced radiating element pair is deployed. However, as can be seen in FIG. 9, the positions of radiating elements 902 and 905 are swapped when comparing unit cells $\mathbf{930}_1$ and $\mathbf{930}_3$. This provides a "paired" layout of radiating elements of the same polarity. In particular, instances of radiating element 902 (which are co-polarized) are placed on each side of the reflector 912 (one in unit cell $\mathbf{930}_1$ and one in unit cell $\mathbf{930}_3$) to give pattern balance. Likewise, instances of radiating element 905 (which are co-polarized, and which are orthogonal to the radiating elements 902) are placed on each side of the reflector 912 (again, one in unit cell $\mathbf{930}_1$ and one in unit cell $\mathbf{930}_3$) to give pattern balance.

In one example, the position and separation of the instances of (co-polarized) radiating elements 902 can be adjusted in the azimuth plane within the width of the reflector 912 to fine tune SPR. In addition, the position and separation of the instances of (co-polarized) radiating elements 905 can also be adjusted in the azimuth plane within the width of the reflector 912 to fine tune SPR. Similar adjustments in the vertical plane separation of the respective instances of radiating elements 902 and 905 may also be applied to fine tune radiated elevation pattern down tilt range and upper elevation radiation pattern side lobe levels. In one example, in an antenna system comprising a linear array of eight unit cells, the pattern of unit cells $\mathbf{930}_1$-$\mathbf{930}_4$ may be repeated. In addition, unit cells, such as $\mathbf{930}_1$ and $\mathbf{930}_3$ may be used in array in which a variety of unit cells of different types may be deployed (e.g., conventional LD dual-polarized antenna elements, LB split diamond antenna elements, LB (non-split) diamond antenna elements, etc.).

It should be noted that examples of the present disclosure describe the use of +45/−45 degree slant linear polarizations. However, although linear polarization is typical, and examples are given using linear polarizations, other embodiments of the present disclosure can be readily arrived at, for example including dual-orthogonal elliptical polarization, or left hand circular and right hand circular polarizations, as will be appreciated by those skilled in the art.

While the foregoing describes various examples in accordance with one or more aspects of the present disclosure, other and further example(s) in accordance with the one or more aspects of the present disclosure may be devised without departing from the scope thereof, which is determined by the claim(s) that follow and equivalents thereof.

What is claimed is:

1. An antenna system comprising:

a first plurality of unit cells arranged as an array of unit cells, each unit cell of the first plurality of unit cells including at least one dual-polarized antenna element for operation in a first radio frequency (RF) range;

wherein the at least one dual-polarized antenna element in at least one unit cell of the first plurality of unit cells is configured as an expanded diamond antenna element comprising a first pair of co-polarized radiating elements and a second pair of co-polarized radiating elements, the first pair of co-polarized radiating elements having a polarization orthogonal to the second pair of co-polarized radiating elements, wherein the at least one unit cell has rectangular bounds including four corners within a plane parallel to a reflector of the antenna system, wherein first and second radiating elements of the first pair of co-polarized radiating elements of the expanded diamond antenna element are disposed in first opposite corners of the four corners across a first diagonal of the rectangular bounds and within the rectangular bounds of the at least one unit cell, and wherein first and second radiating elements of the second pair of co-polarized radiating elements of the expanded diamond antenna element are disposed in second opposite corners of the four corners across a second diagonal of the rectangular bounds and within the rectangular bounds of the at least one unit cell, which are different to the first opposite corners.

2. The antenna system of claim 1:

wherein the first and second antenna elements of the first pair of co-polarized radiating elements are disposed by greater than half a wavelength and less than one wavelength with respect to the first RF range;

wherein the first and second antenna elements of the second pair of co-polarized radiating elements are disposed by greater than half a wavelength and less than one wavelength with respect to the first RF range.

3. The antenna system of claim 2:

wherein the first plurality of unit cells comprises at least a second unit cell with a non-expanded diamond antenna element.

4. The antenna system of claim 1:

wherein the plurality of unit cells includes at least a second unit cell that does not have an expanded diamond antenna element;

wherein the quantity and positions of the at least one unit cell having the expanded diamond antenna element and the quantity and positions of the at least the second unit cell which does not have an expanded diamond antenna element are arranged to provide at least one selected azimuth radiation pattern characteristic.

5. The antenna system of claim 4, wherein the at least one selected azimuth radiation pattern characteristic comprises at least one of:

a half power beamwidth; or a sector power ratio.

6. The antenna system of claim 4, further comprising:

a first radio frequency (RF) splitter; and a second RF splitter;

wherein the at least one unit cell having the expanded diamond antenna element has the first pair of co-polarized component radiating elements driven from the first radio frequency (RF) splitter and has the second pair of co-polarized component radiating elements driven from the second RF splitter.

7. The antenna system of claim 6, further comprising:

a third RF splitter, the third RF splitter having first non-equal split vector ratios; and a fourth RF splitter, the fourth RF splitter having second non-equal split vector ratios;

wherein the plurality of unit cells includes at least a third unit cell which is configured with an expanded diamond antenna element and which has a third pair of co-polarized radiating elements driven from the third RF splitter, and has a fourth pair of co-polarized radiating elements driven from the fourth RF splitter, wherein the first non-equal split ratio vectors of the third RF splitter and the second non-equal split ratio vectors of the fourth RF splitter are configured to provide a selected azimuth radiation pattern including a beam squint via the antenna system.

8. The antenna system of claim 6:

where the at least one unit cell also contains at least a second dual-polarized antenna element for operation in a second RF range, the first RF range and second RF range being non-continuous.

9. The antenna system of claim 8:

where the at least the second dual-polarized antenna element for operation in the second RF range is disposed within the expanded diamond antenna element of the at least one dual-polarized antenna element for operation in the first RF range.

10. The antenna system of claim 8, further comprising:

a second plurality of unit cells deployed adjacent to the first plurality unit cells and arranged as a second array of unit cells.

11. The antenna system of claim 1, further comprising:

a second plurality of unit cells deployed adjacent to the first plurality unit cells and arranged as a second array of unit cells; and a first RF splitter, the first RF splitter to provide a first component signal to drive a first radiating element of the first pair of co-polarized radiating elements of the expanded diamond antenna element of the at least one dual-polarized antenna element in the at least one unit cell, and to provide a second component signal to drive a first radiating element of a third pair of co-polarized radiating elements of an expanded diamond antenna element from a unit cell of the second plurality of unit cells.

12. A method comprising:

arranging quantities and positions of a plurality of unit cells having expanded diamond antenna elements and quantities and positions of at least a second unit cell that does not have an expanded diamond antenna element within an antenna array to provide at least one selected azimuth radiation pattern characteristic via the antenna array, wherein each respective expanded diamond antenna element of the expanded diamond antenna elements comprises:

a first pair of co-polarized radiating elements and a second pair of co-polarized radiating elements, the first pair of co-polarized radiating elements having a polarization orthogonal to the second pair of co-polarized radiating elements, wherein a respective unit cell of the respective expanded diamond antenna element has rectangular bounds including four corners within a plane parallel to a reflector of the antenna array, wherein first and second radiating elements of the first pair of co-polarized radiating elements of the respective expanded diamond antenna element are disposed in first opposite corners of the four corners across a first diagonal of the rectangular bounds and within the rectangular bounds of the respective unit cell, and wherein first and second radiating elements of the second pair of co-polarized radiating elements of the expanded diamond antenna element are disposed in second opposite corners of the four corners across a second diagonal of the rectangular bounds and within the rectangular bounds of the respective unit cell, which are different to the first opposite corners.

13. The method of claim 12, wherein the at least one selected azimuth radiation pattern characteristic includes at least one of:

a half power beamwidth; or a sector power ratio.

14. The method of claim 12, wherein for at least a first expanded diamond antenna element of at least one of the plurality of unit cells, the first pair of co-polarized component radiating elements is driven from a first radio frequency (RF) splitter and wherein the second pair of co-polarized component radiating elements is driven from a second RF splitter.

15. The method of claim 14, wherein for at least a second expanded diamond antenna element of at least one of the plurality of unit cells the first pair of co-polarized radiating elements is driven from a third RF splitter having first unequal split ratio vectors, and has the second pair of co-polarized radiating elements driven from a fourth RF splitter having second unequal split ratio vectors, wherein the method further comprises:

arranging the first non-equal split ratio vectors and the second non-equal split ratio vectors to provide the selected azimuth radiation pattern characteristics via the antenna array.

16. The method of claim 15, wherein the at least one selected azimuth radiation pattern characteristic comprises a beam squint.

17. A method for providing an antenna array comprising at least one unit cell that includes a first expanded diamond antenna element and at least a second unit cell comprising a second expanded diamond antenna element, the second expanded diamond element including a first pair of co-polarized component radiating elements driven from a first RF splitter with first non-equal split ratio vectors and a second pair of co-polarized component radiating elements driven from a second RF splitter with second non-equal split ratio vectors, the method comprising:

arranging the first non-equal split ratio vectors of the first RF splitter and the second non-equal split ratio vectors of the second RF splitter to provide at least one selected azimuth radiation pattern characteristic.

18. The method of claim 17, wherein the at least one selected azimuth radiation pattern characteristic comprises a beam squint.

19. The method of claim 17, wherein the first pair of co-polarized radiating elements has a polarization orthogonal to the second pair of co-polarized radiating elements, wherein the at least the second unit cell has rectangular bounds including four corners within a plane parallel to a reflector of the antenna array, wherein first and second radiating elements of the first pair of co-polarized radiating elements of the second expanded diamond antenna element are disposed in first opposite corners of the four corners across a first diagonal of the rectangular bounds and within the rectangular bounds of the at least the second unit cell, and wherein first and second radiating elements of the second pair of co-polarized radiating elements of the second expanded diamond antenna element are disposed in second opposite corners of the four corners across a second diagonal of the rectangular bounds and within the rectangular bounds of the at least the second unit cell, which are different to the first opposite corners.

* * * * *